US005725721A

United States Patent [19]

Yeh

[11] Patent Number: 5,725,721

[45] Date of Patent: Mar. 10, 1998

[54] MECHANISM OF A BAND ATTACHING DEVICE OF A CASE SEALING MACHINE FOR PREVENTING THE BAND FROM FALLING DOWN

[76] Inventor: Tsuang-Hang Yeh, No. 21, Hsin-Jen 4th Street, Ta-Li City, Taichung Hsien, Taiwan

[21] Appl. No.: 609,528

[22] Filed: Mar. 1, 1996

[51] Int. Cl.[6] ..... B31F 1/00

[52] U.S. Cl. ..... 156/468; 156/475; 156/486; 156/522

[58] Field of Search ..... 156/443, 459, 156/468, 475, 476, 477.1, 479, 486, 522

[56] References Cited

U.S. PATENT DOCUMENTS

| | | | |
|---|---|---|---|
| 4,789,418 | 12/1988 | Rayl | 156/468 |
| 4,855,006 | 8/1989 | Marchetti | 156/378 |
| 4,869,769 | 9/1989 | DiRusso, Jr. et al. | 156/269 |
| 4,936,945 | 6/1990 | Marchetti | 156/468 |
| 4,964,942 | 10/1990 | Tsuda | 156/468 |
| 5,173,140 | 12/1992 | Vasilakes | 156/212 |
| 5,338,384 | 8/1994 | Reichert | 156/212 |
| 5,374,326 | 12/1994 | Marchetti | 156/468 |

*Primary Examiner*—James Sells

*Attorney, Agent, or Firm*—Morton J. Rosenberg; David I. Klein; Jun Y. Lee

[57] ABSTRACT

A mechanism of a band attaching device of a case sealing machine for preventing the band from falling down. A fourth band guiding wheel is disposed under the band stopper boards and movable on the front band pressing wheel support. When the fourth band guiding wheel is positioned at a lowest position, the front edge of the outer surface of the fourth band guiding wheel intersects the band stopper boards and the band is forced to move downward and linearly contact with the band stopper boards on the adhesive face. At this time, the band is urged to forward project into an arch state so as to enhance the upright standing ability of the band without falling down.

4 Claims, 6 Drawing Sheets

MECHANISM OF A BAND ATTACHING DEVICE OF A CASE SEALING MACHINE FOR PREVENTING THE BAND FROM FALLING DOWN

BACKGROUND OF THE INVENTION

The present invention relates to a mechanism of a band attaching device of a case sealing machine for preventing the band from falling down. A movable fourth band guiding wheel is used to force the band (or tape) by its weight so that the band is guided by two band stopper boards and urged to forward project into an arch state so as to enhance the upright standing ability of the band.

A case sealing machine has two band attaching devices for simultaneously sealing the top and bottom faces and a part of the front and rear faces of the case. FIG. 1 shows a conventional case sealing machine in which a front band pressing wheel 11 of each band attaching device 1 serves to press the band 14 (or tape 14) against the case. Prior to each case sealing operation, the end of the band 14 must be kept in a predetermined position in front of the front band pressing wheel 11. Otherwise, it will be impossible to attach the band to the case. The band 14 is a flexible thin membrane so that with respect to the band attaching device for sealing the bottom face of the case, the band 14 is inclinedly upward extended with the top end itself upright standing. Accordingly, the top end of the band 14 is apt to fall down due to its own weight. In order to solve this problem, some manufacturers use a band stopper member 12 disposed near the front band pressing wheel 11. The band stopper member 12 is formed with a V-shaped convex 13 at central portion and a support 15 is disposed in front of the band stopper member 12. The support 15 is formed with a V-shaped notch 16 corresponding to the V-shaped convex 13, whereby the V-shaped convex 13 and the V-shaped notch 16 define a V-shaped passage and a spring 17 forces the band to remain in a V-shaped upright standing state within the passage.

However, when pulling out the band and after the band 14 is cut off, the stopper member 12 and the support 15 keep in contact with the band 14 so that when sealing the case, the band 14 is kept in the V-shaped pattern and is apt to be unsmoothly attached to the case due to fast operation.

In addition, the support 15 is urged by the spring 17 to abut against the band 14, making the same continuously contact with the V-shaped convex 13 and V-shaped notch 16 when pulled out, such that the band 14 is subject to the resistance and may be scraped or stretched. Accordingly, the quality of the band attaching operation cannot be ensured.

Moreover, the spring 17 is subject to failure or fatigue of resilience so that the support 15 may be insufficiently pressed by the spring 17 to affect the band pressing effect.

SUMMARY OF THE INVENTION

It is therefore a primary object of the present invention to provide a mechanism of a band attaching device of a case sealing machine for preventing the band from falling down. A fourth band guiding wheel is movable within a shaft hole, whereby when the fourth band guiding wheel ascends, the band is straightly pulled out so as to avoid rough attaching of the band. In a nonworking state, the fourth band guiding wheel descends to force the band by its weight so that the band is urged to forward project into an arch state so as to enhance the upright standing ability of the band without falling down.

The present invention can be best understood through the following description and accompanying drawing, wherein:

DETAILED DESCRIPTION OF THE PREFERRED EMBODIMENTS

Figure 1:
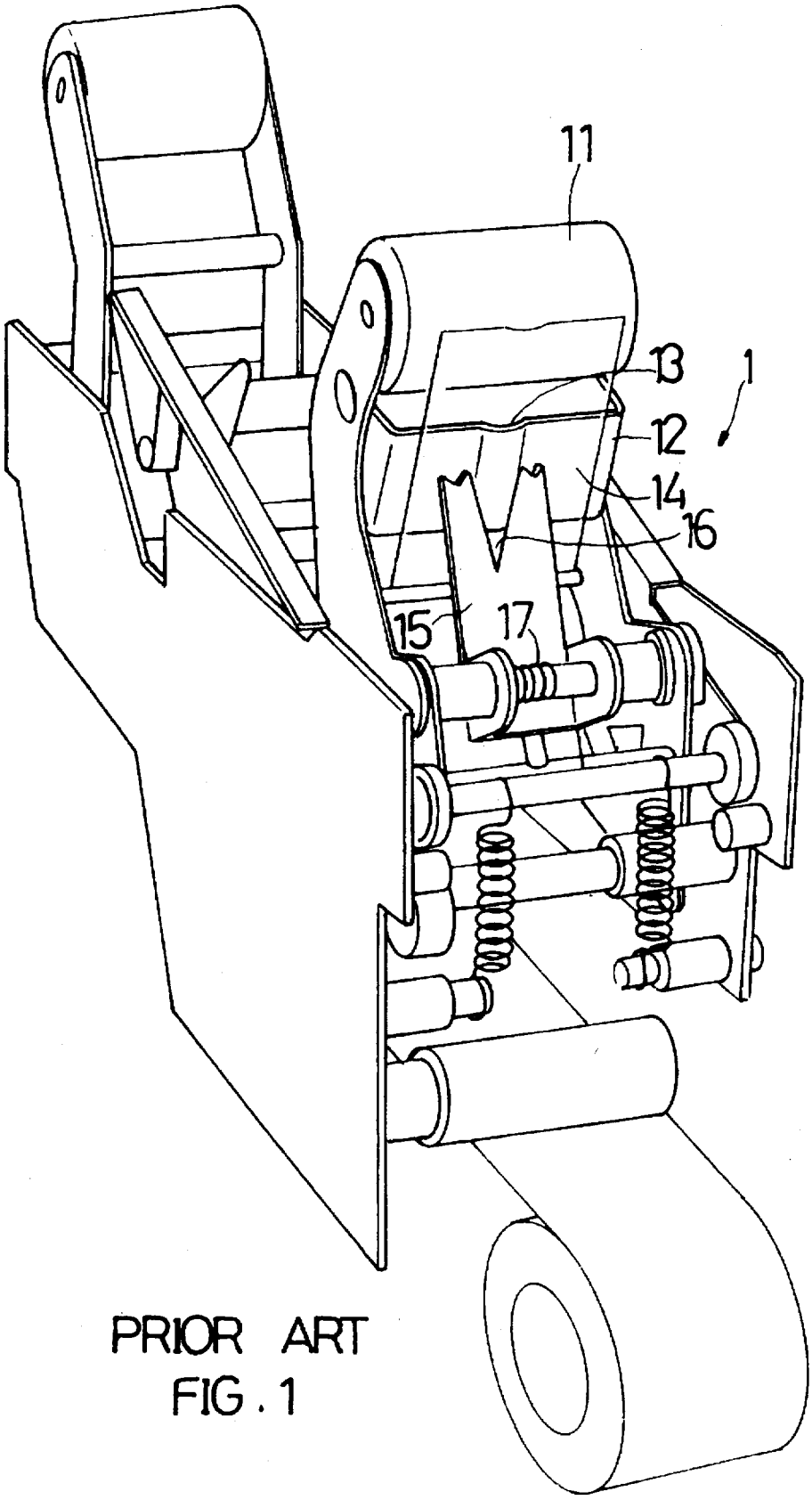
PRIOR ART FIG. 1
FIG. 1 is a perspective view of a conventional band attaching device having a band stopper member, a support and a spring.
Figure 2:
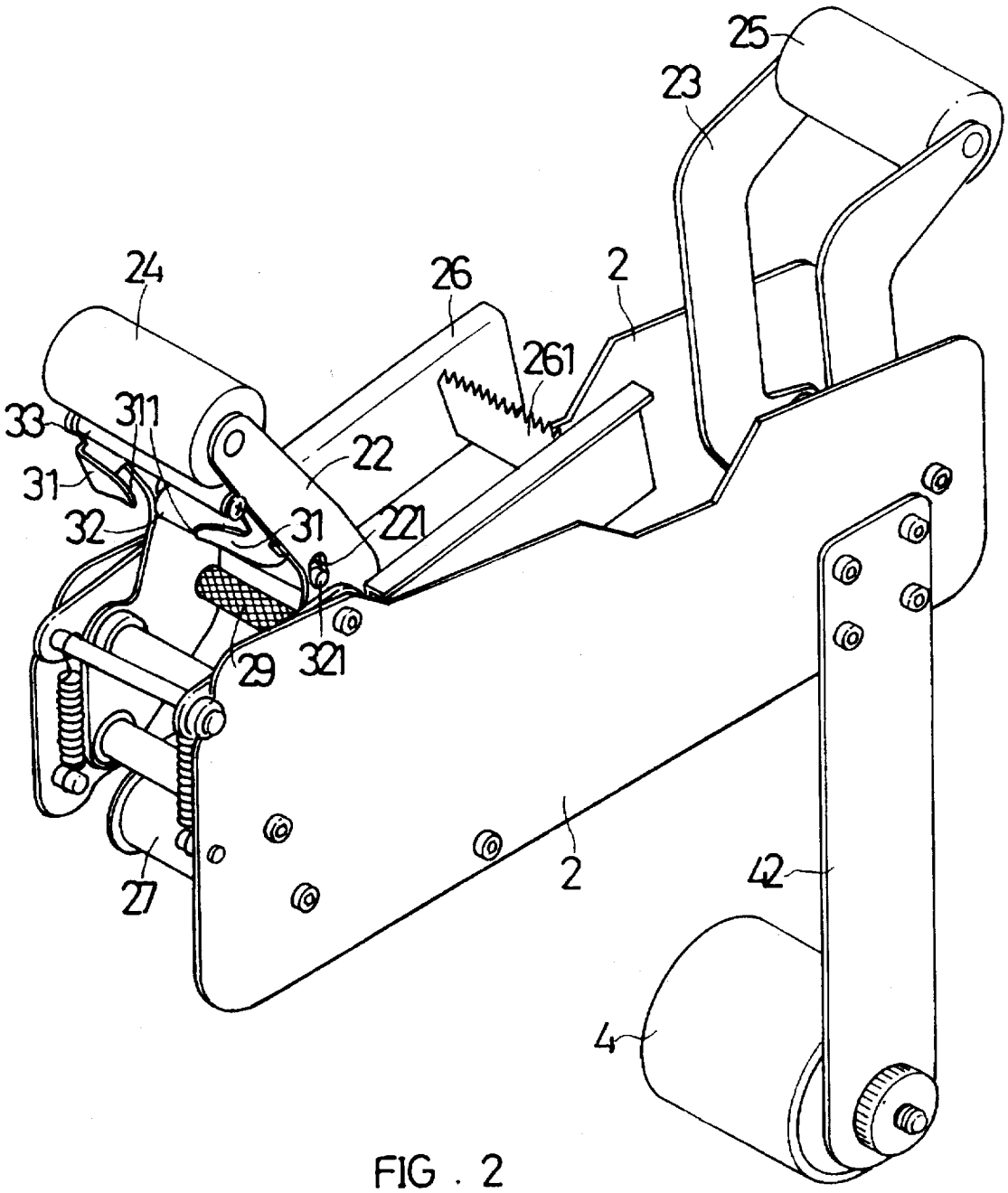
FIG. 2 is a perspective view of the band attaching device of the first preferred embodiment of the present invention.

Please refer to FIG. 2. According to the first preferred embodiment of the present invention, the band attaching device has two locating boards 2, a front and a rear band pressing wheel supports 22, 23 which are movable relative to each other via a linking support 21 and urged by strong spring (not shown), a front and a rear band pressing wheels 24, 25 disposed on the front and rear band pressing wheel supports 22, 23, a band cutting blade support 26, a band cutting blade 261 disposed thereon, a first band guiding wheel 27 through which a band 41 upward passes and a band reel support 42 on which a band reel 4 is disposed. Two band stopper boards 31 are disposed on the front band pressing wheel support 22 under the front band pressing wheel 24. The outer sides of the band stopper boards 31 are secured on two lateral sides of the front band pressing wheel support 22. The band stopper boards 31 respectively extend from two lateral sides to the center and are inclined toward the front side of the front band pressing wheel 24. The free ends of the band stopper boards 31 define a clearance. A second band guiding wheel 29 embossed with checker on surface is disposed on the front band pressing wheel support 22 under the band stopper boards 31. A one-way rotatable band braking wheel 28 and a third band guiding wheel 20 are disposed between the locating boards 2 and between the band reel support 42 and the first band guiding wheel 27.

A fourth band guiding wheel 32 is disposed between the band stopper boards 31 and the second band guiding wheel 29. The fourth band guiding wheel 32 has a predetermined weight and a shaft end 321 movable within a shaft hole 221 of the front band pressing wheel support 22. In this embodiment, the shaft hole 221 is a substantially vertical slot, whereby when the shaft end 321 is positioned at a relatively high position in the slot 221, the front edge of the outer surface of the fourth band guiding wheel 32 is tangent to the two band stopper boards 31, while when the shaft end 321 is positioned at a lowest position in the slot 221, the front edge of the outer surface of the fourth band guiding wheel 32 intersects the band stopper boards 31.

Figure 3:
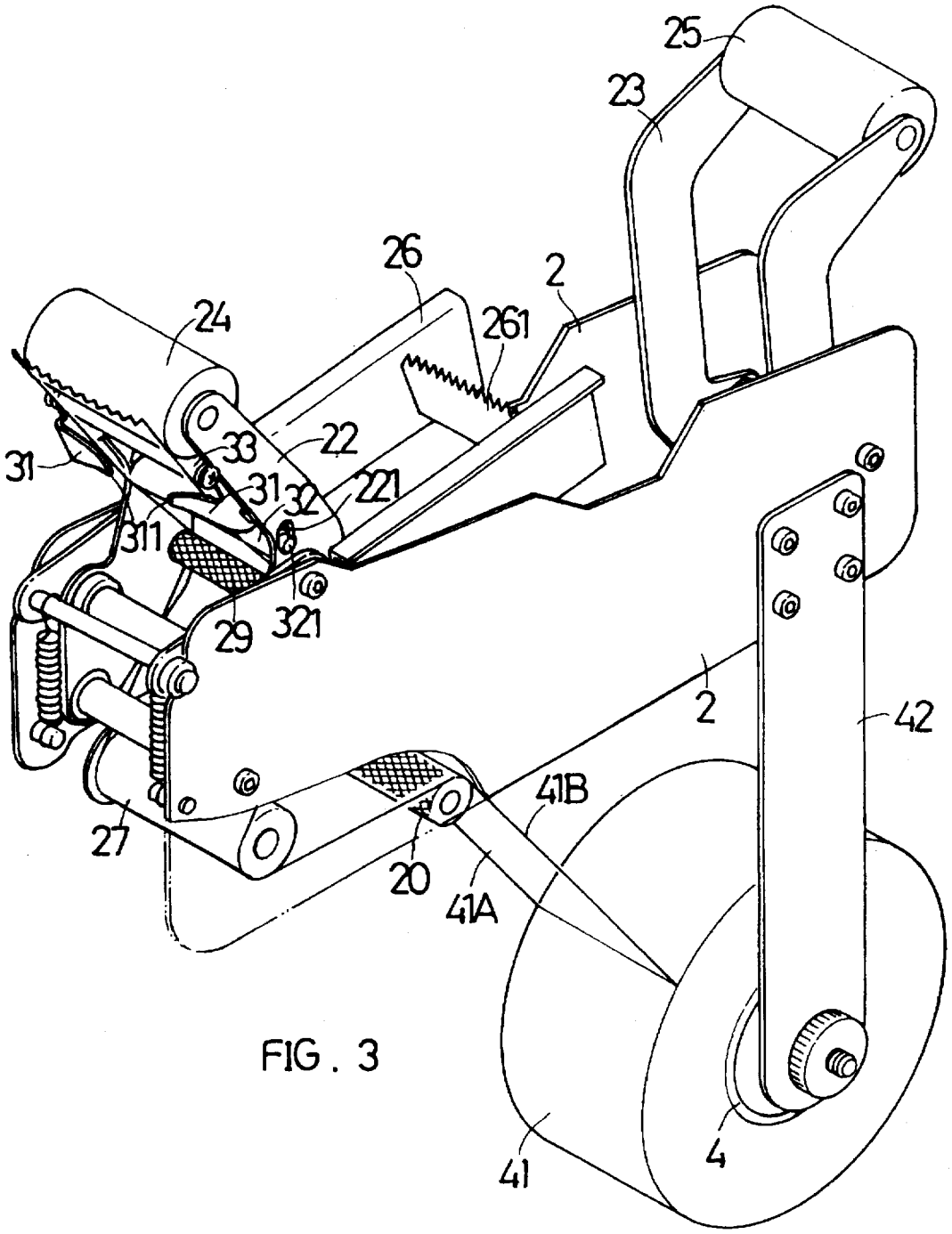
FIG. 3 is a view according to FIG. 2, showing the path of the band of the first preferred embodiment.

Please refer to FIG. 3. After the band 41 is pulled out from the band reel support 42, the band 41 first upward passes through the third band guiding wheel 20 on the adhesive face 41A and then upward passed through the first band guiding wheel 27 and the fourth band guiding wheel 32 and the space between the band stopper boards 31 on the adhesive-free face 41B. Then the end of the band 41 is tangent to the front band pressing wheel 24 on the adhesive-free face 41B.

Figure 4:
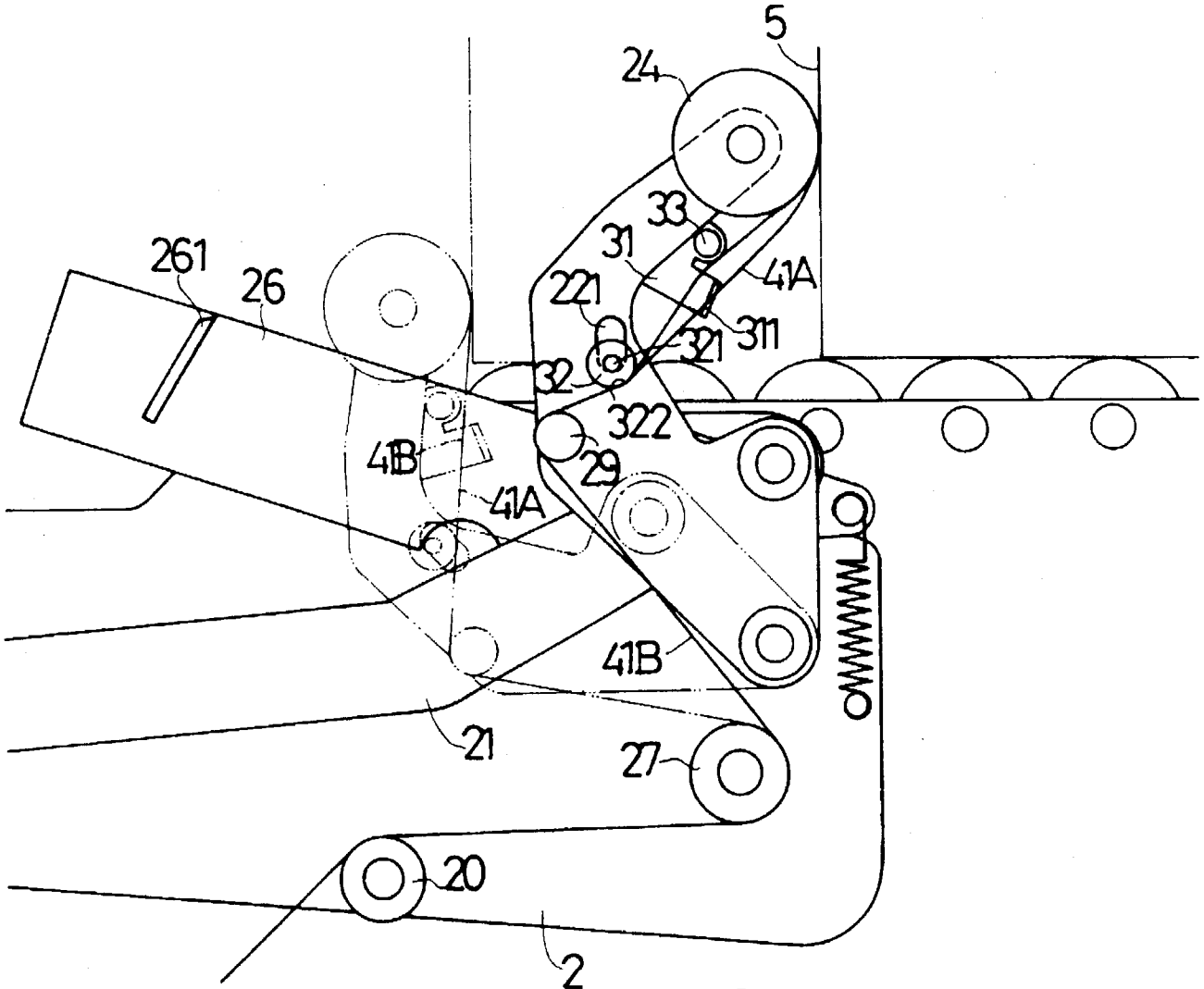
FIG. 4 is a side view of the present invention, showing that the band is pulled by the case in an operation state of the first preferred embodiment.

Please refer to FIG. 4. During the case sealing operation, the band 41 is attached to the front side of the case 5 and pulled out and tensioned by the case 5. At this time, the shaft end 321 of the fourth band guiding wheel 32 is driven to move upward along the slot 221 to the relatively high position. Furthermore, a section of band 41 between the front edge of the outer surface 322 of the fourth band guiding wheel 32 and the front band pressing wheel 24 is tangent to or not in contact with the two band stopper boards 31 so as to facilitate straight pulling out of the band 41.

Figure 6:
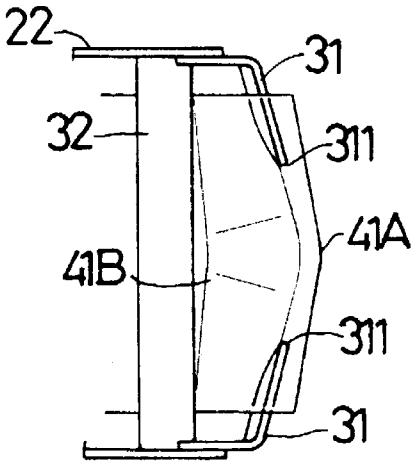
FIG. 6 is a sectional view taken along line VI—VI of FIG. 5.
Figure 5:
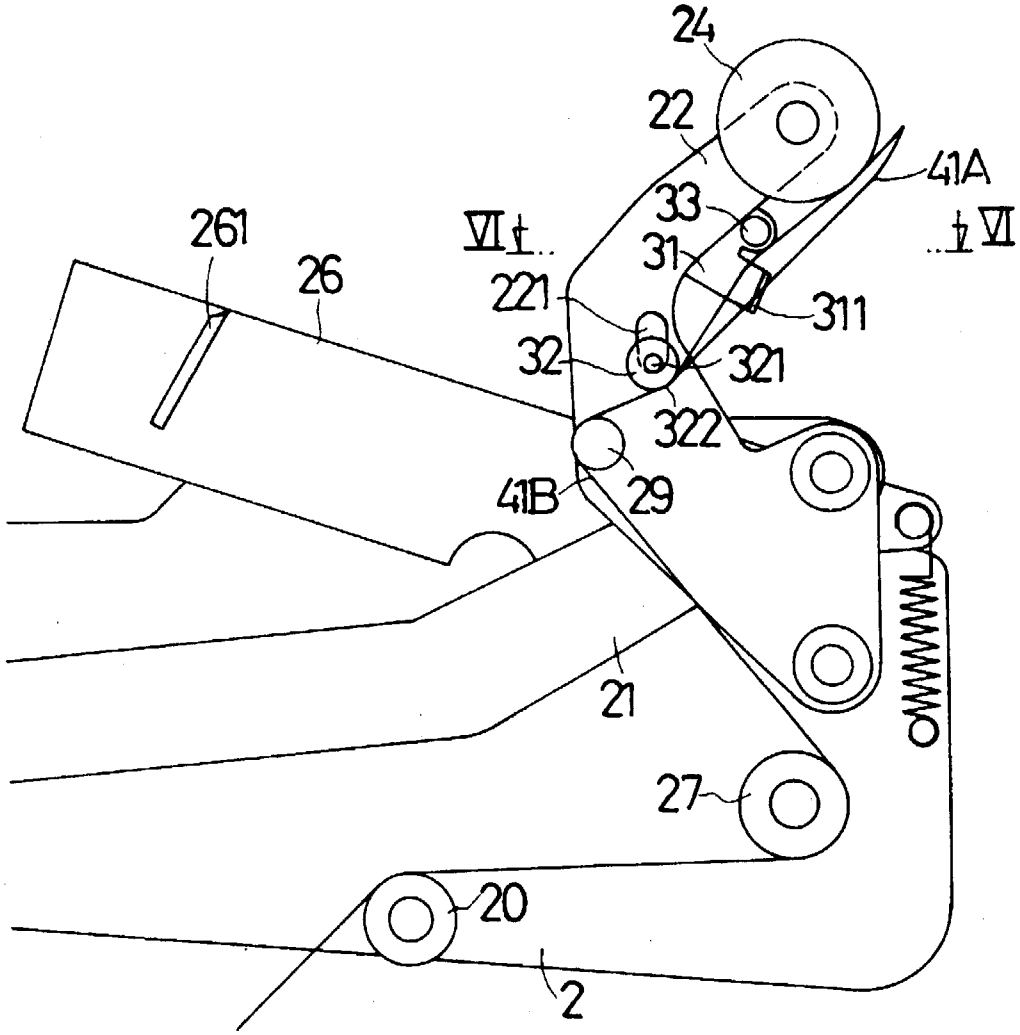
FIG. 5 is a view according to FIG. 4, showing that the band is cut off and the front band pressing wheel support is restored to its home position.

Please refer to FIG. 5. When the case sealing operation is completed, the band 41 is cut off and itself upright stands. At this time, the band 41 is no more tensioned and the shaft end 321 of the fourth band guiding wheel 32 due to its own weight slides downward along the slot 221 to the lowest position so that the front edge of the outer surface 322 of the fourth band guiding wheel 32 intersects the two band stopper boards 31. Simultaneously, the band 41 is such urged by the fourth band guiding wheel 32 that a section of the band 41 from the second band guiding wheel 29 to the band stopper boards 31 is forced and bent as shown in FIG. 6 and guided by the forward inclined extending band stopper boards 31 to project forward into an arch state. Therefore, the upright standing ability of the band 41 is enhanced without falling down.

In conclusion, the present invention enables the band to be straightly pulled out without bending so as to avoid rough attaching of the band. Moreover, the present invention has no spring so that abnormal pressing force and failure of resilience are eliminated.

In addition, a fifth band guiding wheel 33 can be disposed between the front band pressing wheel 24 and the band stopper boards 31 and secured on the front band pressing wheel support 22 so as to offset the clearance between the front band pressing wheel 24 and the band stopper boards 31 and prevent the end of the band 41 from being blown into the clearance by wind.

Figure 8:
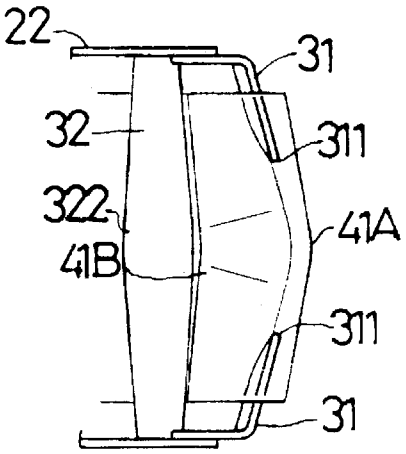
FIG. 8 is a sectional view taken along line VIII—VIII of FIG. 7.
Figure 7:
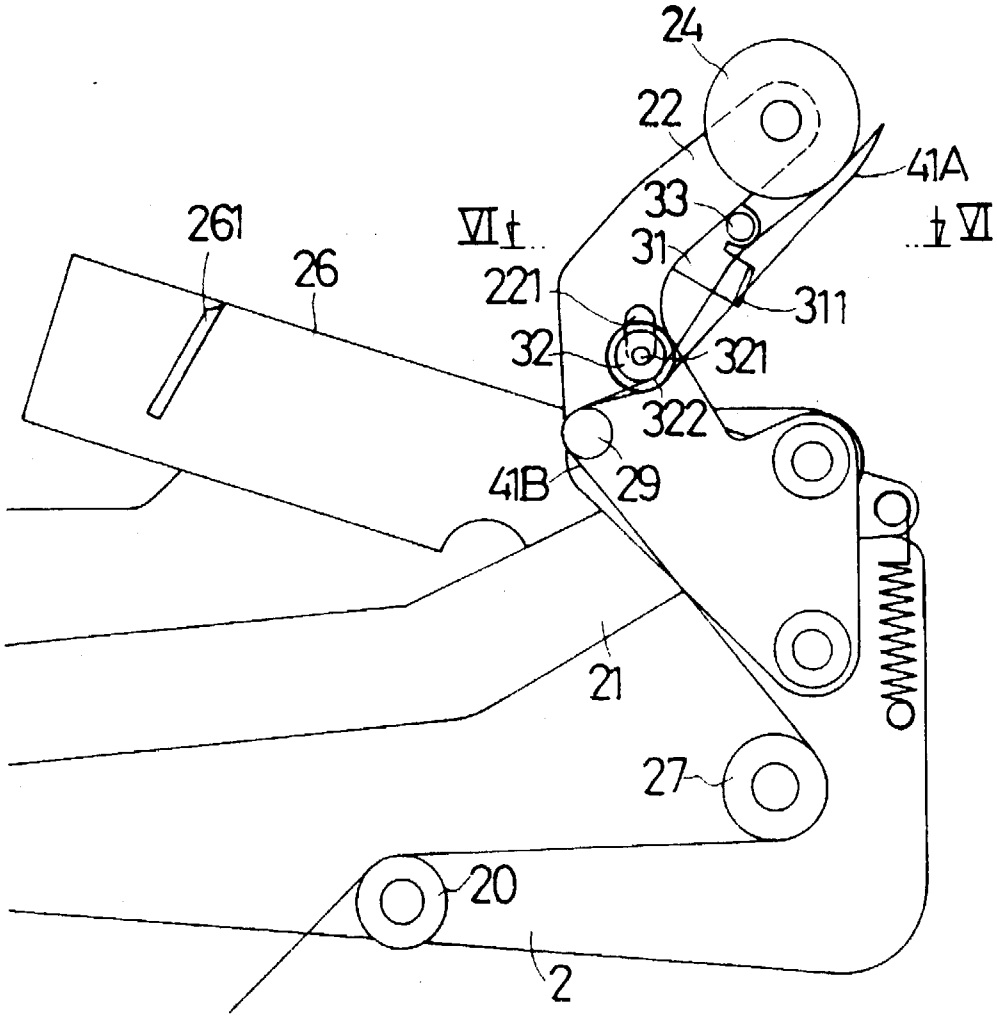
FIG. 7 is a side view showing the structure of the second preferred embodiment.

Please refer to FIGS. 7 and 8. They illustrate the structure of the second preferred embodiment of the present invention. In which, the outer surface 332 of the fourth band guiding wheel 32 is a convex curved surface, so that a slightly curved space is formed between the convex curved surface and these two band stopper boards 31. Due to the shape and weight of the fourth band guiding wheel, it will press on the adhesive-free face 41B of the band 41 so that the band 41 is urged to forward project into an arch state.

It is to be understood that the above description and drawings are only used for illustrating one embodiment of the present invention, not intended to limit the scope thereof. Any variation and derivation from the above description and drawings should be included in the scope of the present invention.

What is claimed is:

1. A mechanism of a band attaching device of a case sealing machine for preventing the band from falling down, said band attaching device comprising two locating boards, a front and a rear band pressing wheel supports which are movable relative to each other via a linking support and urged by a strong spring, a front and a rear band pressing wheels disposed on the front and rear band pressing wheel supports, a band cutting blade support, a band cutting blade disposed thereon, a first band guiding wheel through which a band upward passes and a band reel support on which a band reel is disposed, two band stopper boards being secured on the front band pressing wheel support under the front band pressing wheel, the band stopper boards respectively extending from two lateral sides to the center and being inclined toward the front side of the front band pressing wheel, free ends of the band stopper boards defining a clearance, a second band guiding wheel embossed with checker on surface being disposed on the front band pressing wheel support under the band stopper boards, whereby after the band is pulled out from the band reel support, the band first upward passes through the first band guiding wheel on the adhesive-free face and then upward passed through the second band guiding wheel and the space between the band stopper boards on the adhesive face with the end of the band tangent to the front band pressing wheel on the adhesive-free face, said mechanism being characterized in that:

a fourth band guiding wheel is disposed between the band stopper boards and the second band guiding wheel, the fourth band guiding wheel having a shaft end movable within a shaft hole of the front band pressing wheel support, whereby when the shaft end is positioned at a relatively high position in the shaft hole, a section of band between the front edge of the outer surface of the fourth band guiding wheel and front band pressing wheel is tangent to or not in contact with the band stopper boards, while when the shaft end is positioned at a lowest position in the shaft hole, the front edge of the outer surface of the fourth band guiding wheel intersects the band stopper boards.

2. A mechanism as claimed in claim 1, wherein a one-way rotatable band braking wheel and a third band guiding wheel are disposed between the locating boards and between the band reel support and the first band guiding wheel.

3. A mechanism as claimed in claim 1, wherein a fifth band guiding wheel is disposed between the front band pressing wheel and the band stopper boards and secured on the front band pressing wheel support.

4. A mechanism as claimed in claim 1, wherein said outer surface of the fourth band guiding wheel is a convex curved surface.

* * * * *